US007871113B2

(12) United States Patent
Watanabe et al.

(10) Patent No.: US 7,871,113 B2
(45) Date of Patent: Jan. 18, 2011

(54) DOOR UNIT FOR COLD STORAGE

(75) Inventors: Yasuhide Watanabe, Saitama-ken (JP); Yasushi Sakata, Tatebayashi (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 11/391,363

(22) Filed: Mar. 29, 2006

(65) Prior Publication Data

US 2006/0220392 A1 Oct. 5, 2006

(30) Foreign Application Priority Data

Mar. 30, 2005 (JP) ..... 2005/097611

(51) Int. Cl.
*E05B 3/00* (2006.01)

(52) U.S. Cl. ..... 292/336.3; 292/241

(58) Field of Classification Search ..... 292/241, 292/336.3, DIG. 30, 240, 100, 102, 108, 292/200, 203, 210, 304; 16/412; 312/405; 220/318

See application file for complete search history.

(56) References Cited

U.S. PATENT DOCUMENTS 1,658,481 A * 2/1928 Ekman ..... 292/241
1,887,210 A * 11/1932 Miller ..... 292/241
2,212,563 A * 8/1940 Groeger ..... 292/224
2,256,447 A * 9/1941 Burke ..... 292/223
2,315,337 A * 3/1943 Katz ..... 292/74
2,394,784 A * 2/1946 Kelly ..... 292/240
2,732,238 A * 1/1956 Dornberg ..... 292/113
2,893,772 A * 7/1959 Edwards ..... 292/223
4,082,077 A * 4/1978 Marfatia et al. ..... 126/197
4,704,882 A * 11/1987 Takasaki ..... 70/215
4,826,222 A * 5/1989 Davis ..... 292/241
6,543,820 B2 * 4/2003 Kelly ..... 292/97
7,100,951 B2 * 9/2006 Jien ..... 292/207

FOREIGN PATENT DOCUMENTS

BE 337175 * 5/1854
JP 2001-183052 7/2001

* cited by examiner

*Primary Examiner*—Carlos Lugo
*Assistant Examiner*—Kristina R Fulton
(74) *Attorney, Agent, or Firm*—Kratz, Quintos & Hanson, LLP

(57) ABSTRACT

The invention has an object to provide a door unit for a cold storage, enabling easy opening and closing operations of a door by engaging a latch with a latch receiver. The door unit includes a handle pivotally mounted on the side face of an outer door on its non-pivotal side at a predetermined height, and a latch receiver provided on the forward portion of a side surface of a main body at a height corresponding to the handle. The handle includes a grip to be grasped by fingers of a hand, and a latch detachably engageable with the latch receiver so that the latch engages a roller of the latch receiver in a state of the substantially vertical grip, and when the grip is pivotally moved in a direction away from the main body to a position where the grip intersects a horizontal plane at a predetermined angle, the pivotal movement of the handle is stopped and the latch disengages from the roller of the latch receiver.

8 Claims, 7 Drawing Sheets

DOOR UNIT FOR COLD STORAGE

BACKGROUND OF THE INVENTION

The present invention relates to a door unit for a cold storage whose storage compartment is cooled to extremely low temperatures, for example, −80° C. or lower.

Cold storages of this kind, particularly ultra-deep freezers whose storage compartments are cooled to extremely low temperatures, such as −80° C. or lower have in the past been provided with an inner door for closing an opening of the front surface of the storage compartment in a freely opening and closing manner and an outer door provided outwardly of the inner door for closing an opening of the front surface of a main body in a freely opening and closing manner (refer to, for example, official gazette of Japanese Patent Application Laid Open No. 183,052/2001). Moreover, the outer door of the cold storage of this kind has been formed at its front face or side face with a handle portion with a recess on which fingers put for opening and closing the outer door, and has been provided on the side face with a pivotable latch (engaging member) adapted to engage a latch receiver extending from the side face of the main body for preventing the outer door from being opened.

In this way, in the cold storage of the prior art, when the outer door is to be opened, required are operations first for disengaging the latch and then for putting a hand on the handle portion and pulling it. Moreover, when the outer door is to be closed, after the outer door has been closed, the latch has to be pivotally moved so as to engage a pin on the side of the main body. For these reasons, the opening and closing operations for the outer door are very troublesome. On the one hand, a construction capable of opening an inner door in conjunction with a pivotal movement of a latch of the inner door has been devised in the Japanese Patent Application (patent document No. 1) described above.

The present invention is intended to provide a door unit for a cold storage, enabling easy operations for opening and closing a door by engaging a latch with a latch receiver on the side of a main body in order to eliminate such disadvantages of the prior art.

SUMMARY OF THE INVENTION

The door unit according to the first invention of the present application is applicable to a cold storage including a main body whose front surface opening is closed in an openable and closable manner by means of a door whose one side is pivotally supported on the main body, the door unit comprising a handle pivotally mounted on one side face of the door on its non-pivotal side at a location of a predetermined height, and a latch receiver provided on the forward portion of a side surface of the main body at a height corresponding to the height of the handle, the handle comprising a grip adapted to be grasped by fingers of a hand, and a latch detachably engageable with the latch receiver so that the latch engages the latch receiver in a state that the grip is substantially vertical, and when the grip is pivotally moved in a direction away from the main body to a position where the grip intersects a horizontal plane at a predetermined angle, the pivotal movement of the handle is stopped and the latch disengages from the latch receiver.

The door unit for a cold storage according to the second invention of the present application is so configured that in the above invention, the latch has a shape such that a distance from the pivot shaft of the handle to the latch progressively increases toward the tip of the latch.

The door unit for a cold storage according to the third invention of the present application is so configured that in the each of the inventions, the handle comprises a stopper which regulates movement of the door toward the main body in the state that the latch engages the latch receiver.

The door unit for a cold storage according to the fourth invention of the present application is so configured that in the each of the inventions, the handle comprises a handle side lock insertion hole which is aligned with a main body side lock insertion hole provided in the latch receiver in the state that the latch engages the latch receiver.

The door unit according to the first invention of the present application is applicable to a cold storage including a main body whose front surface opening is closed in an openable and closable manner by means of a door whose one side is pivotally supported on the main body, the door unit comprising a handle pivotally mounted on one side face of the door on its non-pivotal side at a location of a predetermined height, and a latch receiver provided on the forward portion of a side surface of the main body at a height corresponding to the height of the handle, the handle comprising a grip adapted to be grasped by fingers of a hand, and a latch detachably engageable with the latch receiver so that the latch engages the latch receiver in a state that the grip is substantially vertical, and when the grip is pivotally moved in a direction away from the main body to a position where the grip intersects a horizontal plane at a predetermined angle, the pivotal movement of the handle is stopped and the latch disengages from the latch receiver. Therefore, the door is held closed in the state that the latch of the handle engages the latch receiver of the main body. At this time, as the grip of the handle becomes substantially vertical along the door, the grip does not extend significantly from the main body.

From this state, the handle is pivotally moved by the grip grasped by fingers of a hand, and when the grip arrives at a position where the grip intersects a horizontal plane at a predetermined angle, the pivotal movement of the handle is stopped. And, in this state, as the engagement of the latch with the latch receiver is released, the grip grasped by the fingers is pulled to the side of an operator to open the door. On the other hand, when the door is to be closed, the door is moved toward its closed position by the grip grasped by the fingers to pivotally move the grip from the stopped state described above to its vertical position so that the latch of the handle engages the latch receiver of the main body.

In this manner according to the invention, it becomes possible to realize the engagement with the main body for holding the closed state of the door and the disengagement from the main body in a series of operations for opening and closing the door, thereby enabling the opening and closing operations of the door to be remarkably easy. Moreover, as the latch is provided on the handle, reduction in number of parts can be achieved. In the state that the engagement of the latch with the latch receiver has been released, as the grip is stopped in a position intersecting the horizontal plane at a predetermined angle, the operations for pulling or pushing the door can be very easily carried out.

In the second invention of the present application, in addition to the above features, the latch is so configured that the distance from the pivot shaft of the handle progressively increases toward the tip of the latch, so that upon closing the door, the tip of the latch becomes easy to engage the latch receiver, while thereafter upon pivotally moving the grip toward its vertical position, the latch in turn operates in a direction to push the door toward the main body, which is very effective for a cold storage of extremely low temperatures, particularly emphasizing a hermetic condition.

In the third invention of the present application, in addition to the respective inventions described above, the handle comprises a stopper which regulates movement of the door toward the main body in the state that the latch engages the latch receiver, thereby preventing the problem of the door being attracted toward the main body by the negative pressure immediately after the door has been closed, particularly in a cold storage whose storage compartment becomes at extremely low temperatures.

In the fourth invention of the present application, moreover, in addition to the respective inventions described above, the handle comprises a handle side lock insertion hole which is aligned with a main body side lock insertion hole provided in the latch receiver in the state that the latch engages the latch receiver. Therefore, by inserting a lock into the aligned insertion holes in the state that the latch of the handle engages the latch receiver, the door can be easily locked.

DETAILED DESCRIPTION OF THE EMBODIMENTS

Figure 1:
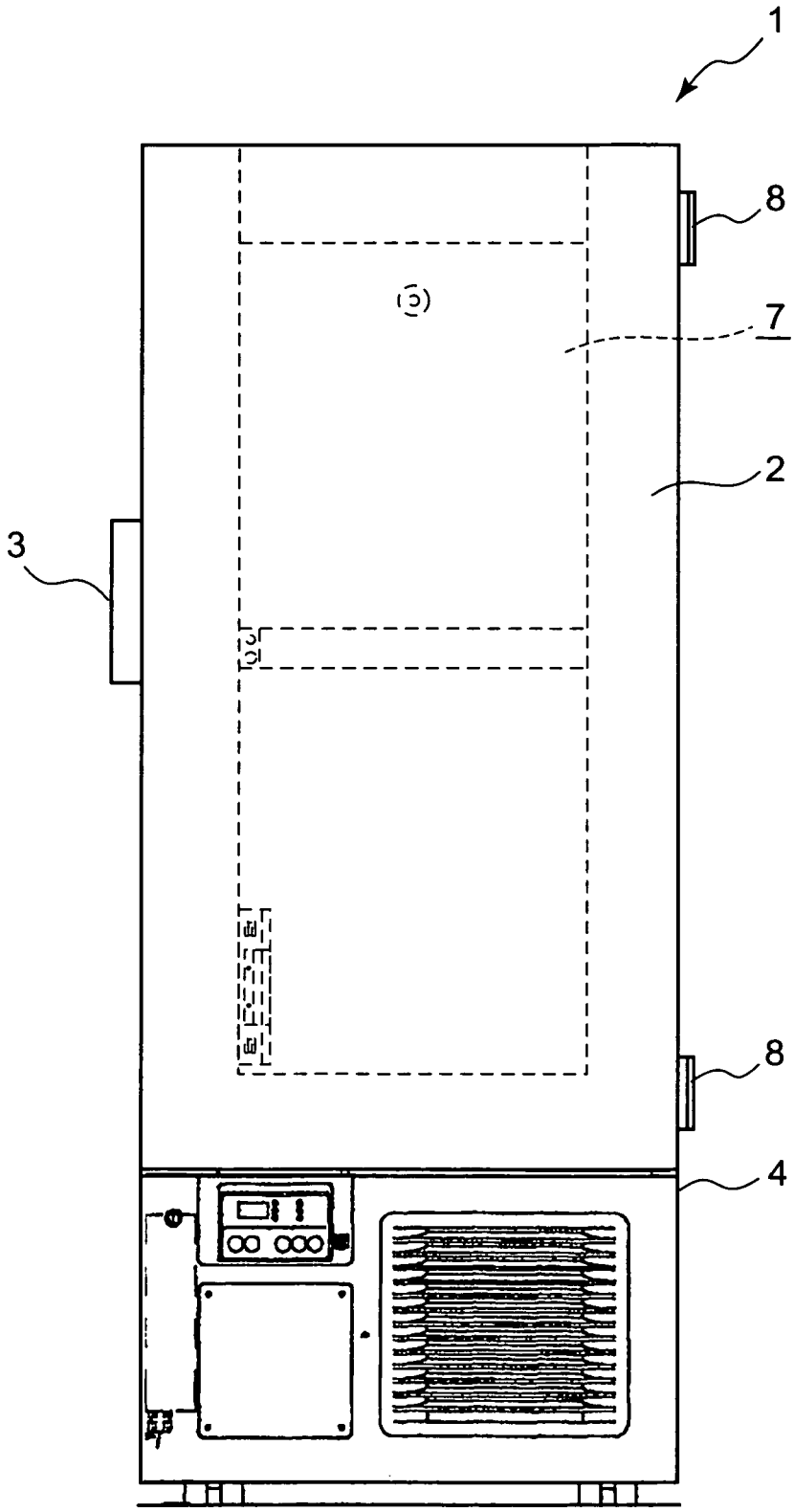
FIG. 1 is a front elevation of an ultra-deep freezer as an embodiment of a cold storage providing the invention.

One embodiment configuration of the present invention will be explained in detail with reference to the drawings hereinafter. The ultra-deep freezer 1 of the embodiment comprises a vertical type thermal insulation housing whose main body 4 opens in its front face, and a storage compartment 7 is configured in the main body 4. The storage compartment 7 is cooled by a freezer unit (not shown) to extremely low temperatures, for example, −80.degree. C. or lower. The opening in the front face of the main body 4 is freely opened and closed by an outer door 2 (the thermal insulation door as the door according to the invention) which is pivotally mounted with its observer's right side on the main body 4 by means of hinges 8. The front opening of the storage compartment 7 constructed in the main body 4 is freely opened and closed by an inner door (not shown) positioned inside the outer door 2. In the case of a cold storage that the interior of a storage compartment 7 is not cooled to such extremely low temperatures, no inner door is provided so that an outer door 2 closes the front opening of the storage compartment 7, which is also the front opening of the main body 4.

Also, a handle 3 is pivotally attached to the left side face of the non-pivoted end of the outer door 2 or on its observer's left side at a position at a predetermined height which is slightly lower than a person's shoulder. A latch receiver 6 is attached to the forward portion of the left side surface of the main body 4 at a position corresponding to the height of the handle 3 in the state of the outer door 2 closed. The door unit according to the invention is constructed by these outer door 2, handle 3, latch receiver 6 and a mounting base 21 later described.

The handle 3 integrally comprises a main body 11 including at front side of the center of its inner surface a cylindrical pivot shaft portion (pivot shaft) 12 as a center of pivotal movement, a grip 13 standing upright from the front end of the main body 11, and a latch 14 extending rearward from the rear portion of the inner surface of the main body 11 and then extending downwardly. In this case, the grip 13 has a length dimension and a sectional shape enabling it to be grasped by fingers of a hand and stands upright from the main body 11. Moreover, the main body 11 is formed with a projection 16 on the inner surface at a location near to the pivot shaft portion 12 on the side of the grip 13, and with a handle side lock insertion hole 17 below the latch 14 as a through-hole.

Figure 3:
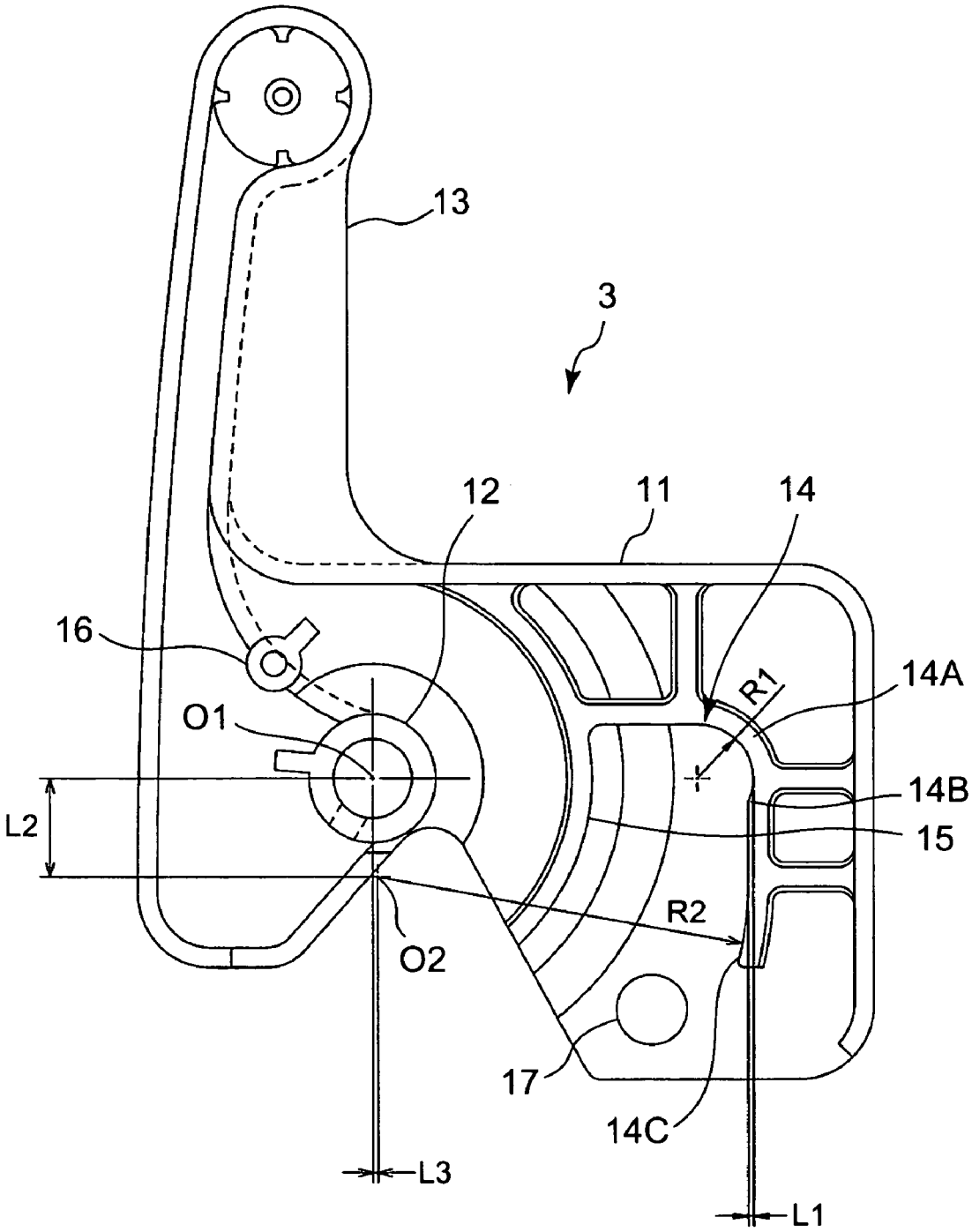
FIG. 3 is a rear view of the handle of FIG. 2.

The latch 14 includes a roller receiver 14A having a radius R1 at a corner and is formed below the roller receiver 14A with a protrusion 14B extending a very small dimension L1 toward the pivot shaft portion 12. The forward end 14C (lower end portion) of the latch 14 is in the form of a circular arc of a radius R2 having a center O2 located below the center O1 of the pivot shaft portion 12 by a distance L2 and shifted a very small distance L3 toward the forward end 14C. The upper end of the forward end 14C is continuous with the protrusion 14B. In this way, the distance from the pivot shaft portion 12 to the forward end 14C progressively increases toward the tip (lower end) of the forward end 14C, and the forward end 14C becomes continuous with the protrusion 14B at the proximal end (upper end) of the forward end 14C where the distance from the pivot shaft portion 12 is the minimum. Moreover, such a latch 14 is formed on the side of the pivot shaft portion 12 with a circular arc wall 15 inwardly extending and concentric to and a predetermined distance spaced from the pivot shaft portion 12. The circular arc wall 15 serves as a stopper (FIG. 3) in the present invention.

On the one hand, fixed to the side face of the outer door 2 is the mounting base 21 including a cylindrical bearing 22 into which a collar 23 is inserted. Inserted into the collar 23 in the bearing 22 from the side of the surface of the outer door 2 is a pin 18 whose one end extends from the bearing 22 and onto the other end of which a washer 24 is inserted. The other end of the pin 18 has a groove 18A formed therein into which a retaining ring 26 is snapped, thereby preventing the pin 18 from removing in the direction toward its one end.

Figure 4:
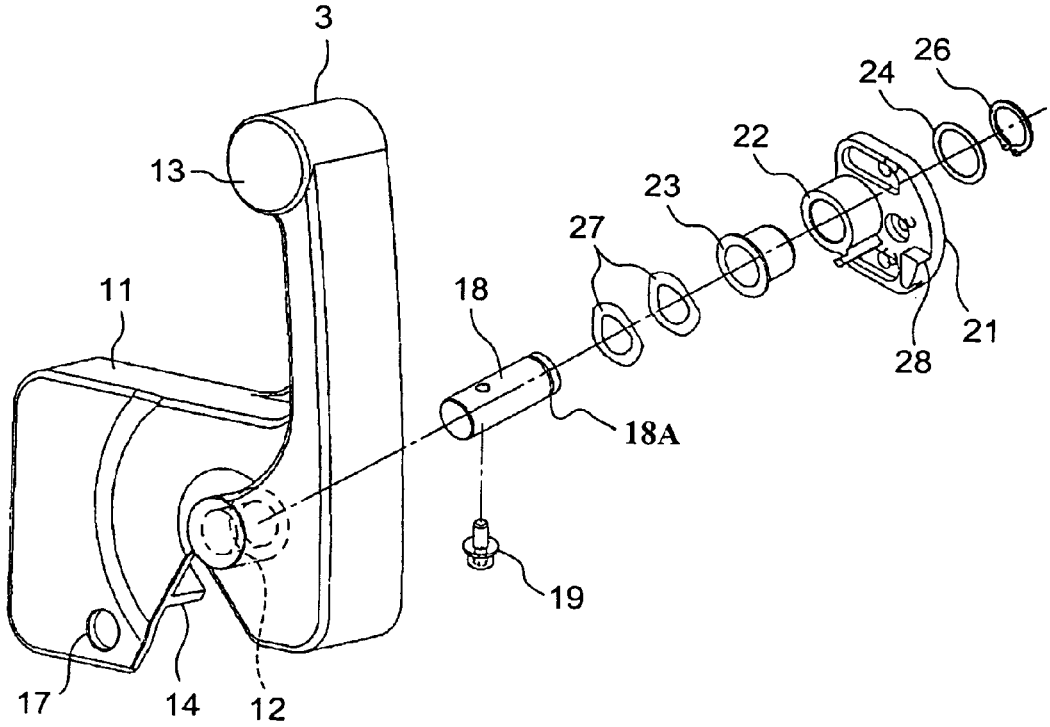
FIG. 4 is an exploded perspective view of the handle portion of FIG. 2.

The pin 18 thus provided in the mounting base 21 in a manner extending therefrom is inserted into the pivot shaft portion 12 of the handle 3 and fixed thereat by means of a set screw 19 so that the handle 3 is pivotally mounted on the mounting base 21 (on the side face of the outer door 2). In this case, wave washers 27, 27 are interposed between the end faces of the pivot shaft portion 12 and the bearing 22 so that a predetermined resistance or counter force is provided to the pivotal movement of the handle 3 (FIG. 4).

The mounting base 21 is formed with an abutment portion 28 at the lower end of its forward portion, and when the grip 13 is pivotally moved forwardly from its substantially upstanding position through a predetermined angle to a position which is, for example, at 45° relative to a horizontal plane, the projection 16 of the handle 3 abuts against the abutment portion 28 of the mounting base 21 so that the pivotal movement of the handle 3 is stopped.

Figure 5:
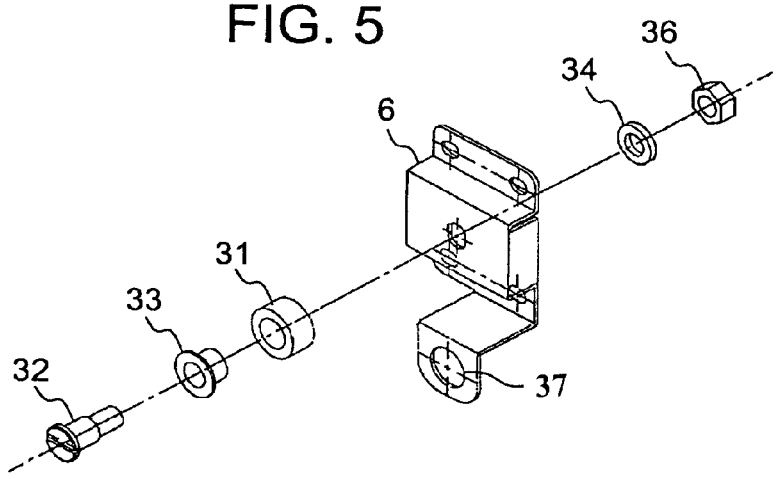
FIG. 5 is an exploded perspective view of the latch receiver of FIG. 2.

On the other hand, pivotally mounted on the latch receiver 6 attached to the side face of the main body 4 is a roller 31 by means of a screw 32, a collar 33, a washer 34 and a nut 36. The roller 31 has a size so as to advance between the latch 14 and the circular arc wall 15. Moreover, the latch receiver 6 is formed at its lower portion with a main body side lock insertion hole 37 (FIG. 5).

Figure 2:
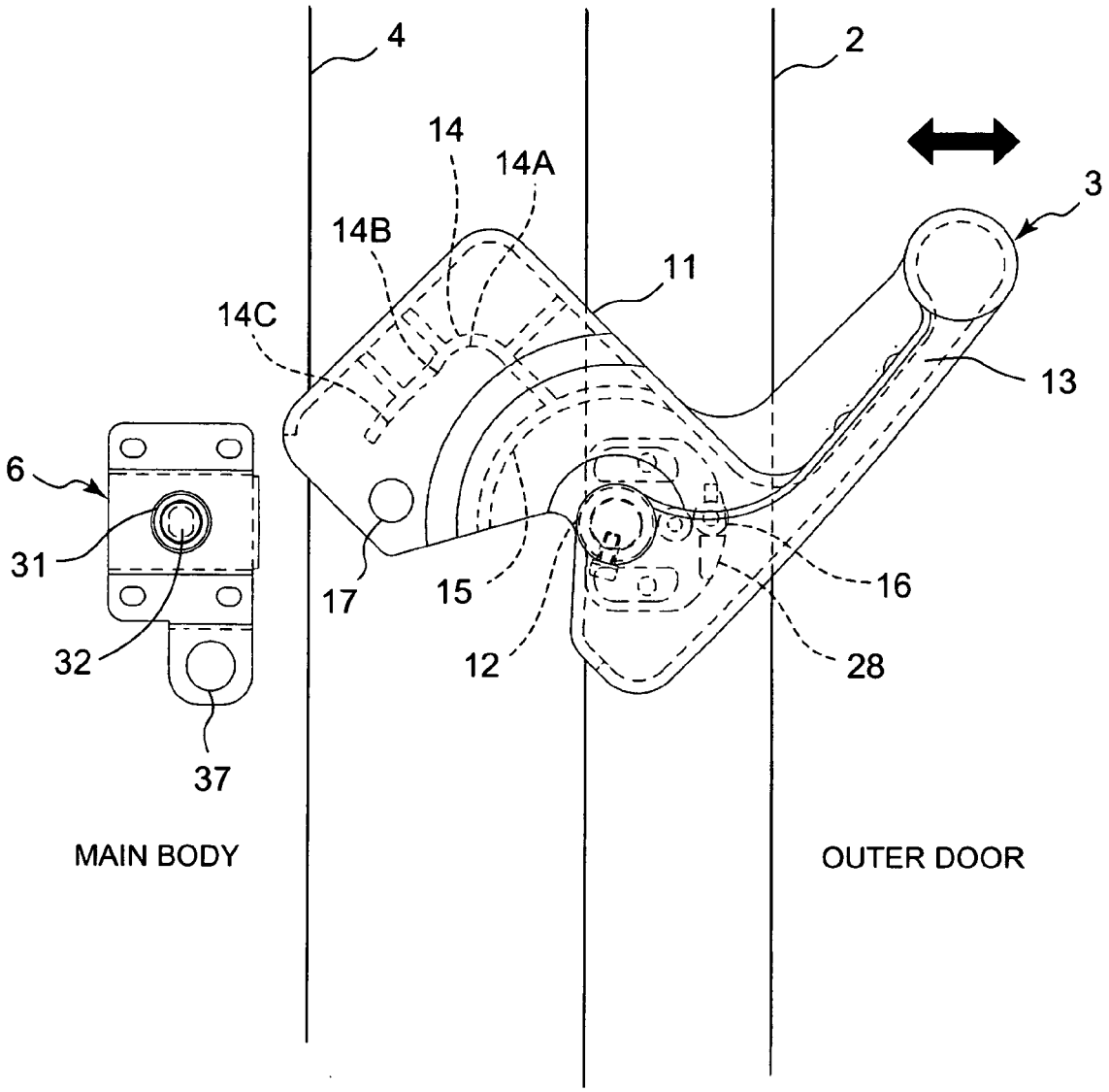
FIG. 2 is a front view of a handle provided on the outer door of the ultra-deep freezer shown in FIG. 1 and a latch receiver provided on a main body.

Opening and closing operations of the outer door 2 of the ultra-deep freezer 1 constructed as described above will then be explained with reference to FIGS. 6 to 10. FIG. 2 illustrates the outer door 2 opened, in which state the projection 16 of the handle 3 abuts against the abutment portion 28 of the mounting base 21 and the grip 13 obliquely stands at an angle of substantially 45° with respect to the horizontal plane so that the outer door 2 can be easily pulled toward an operator or pushed toward the main body 4 with the grip 13 grasped by the fingers.

Figure 6:
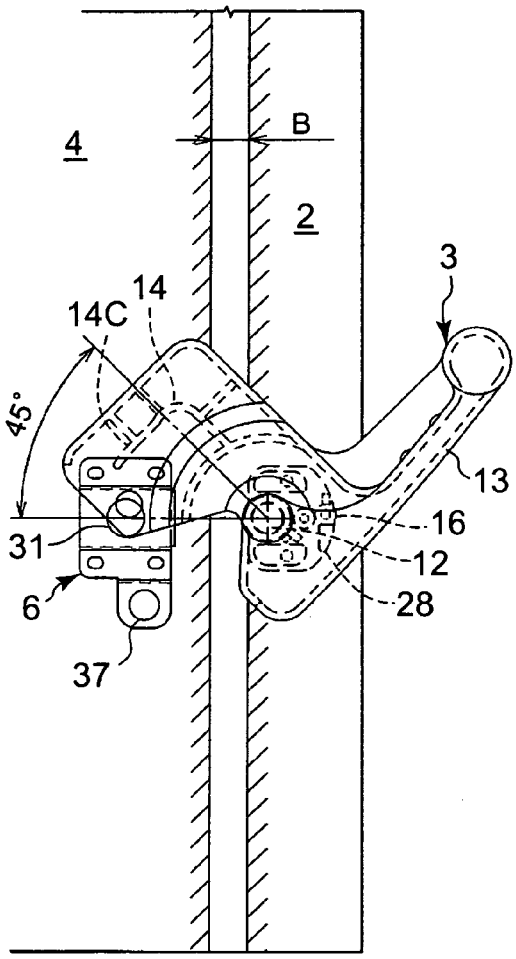
FIG. 6 is a view for explaining the operation for the engagement of the latch of the handle and the latch receiver of FIG. 2.

From this condition, on closing the outer door 2, a gasket (not shown) attached to the inner face of the outer door 2 in time abuts against the main body 4, while a gasket (not shown) attached to the edges of the opening of the main body 4 abuts against the outer door 2. A spacing between the outer door 2 and the main body 4 in this state is assumed to be B (on the order of 20 mm in the embodiment). At this time, moreover, the forward end 14C of the latch 14 of the handle 3 is positioned above the roller 31 of the latch receiver 6 as shown in FIG. 6. In this state, further, the latch 14 has not yet engaged the roller 31 of the latch receiver 6. Therefore, the outer door 2 is still pivotally movable so that it is possible to open the opening of the front face of the main body 4 by pulling the grip 13 toward the operator.

Figure 7:
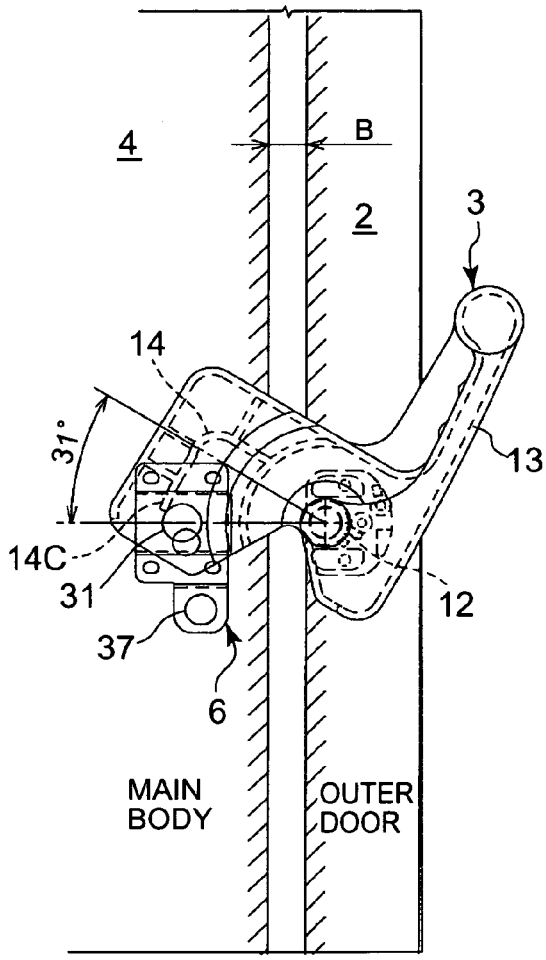
FIG. 7 is a similar view for explaining the operation for the engagement of the latch of the handle and the latch receiver of FIG. 2.

Upon the grip 13 being pushed rearward to its vertical position to pivotally move the handle 3 in the counterclockwise direction in FIG. 6, the forward end 14C of the latch 14 starts engaging the roller 31 at a position where the grip 13 is at an angle of about 31° relative to the vertical plane (FIG. 7). At this time, as the forward end 14C of the latch 14 is configured to increase the distance from the pivot shaft portion 12 to the forward end 14C toward its tip (lower end), the roller 31 of the latch receiver 6 smoothly advances onto the side of the pivot shaft portion 12 of the latch 14 and engages the forward end 14C.

Upon the grip 13 being further pivotally moved toward its vertical position or the handle 3 being pivotally moved in the counterclockwise direction in FIG. 7, the roller 31 abuts against the face of the latch 14 on the side of the pivot shaft portion 12 and slidably moves in this state and reaches the proximal end of the forward end 14C where the grip 13 is positioned at an angle of about 19° relative to a vertical plane. At this time, as the forward end 14C is so configured that the distance to the pivot shaft portion 12 progressively decreases from the tip to the proximal end of the forward end 14C, with the result that the outer door 2 is being pulled toward the main body 4 during the movement of the roller 31 from the tip to the proximal end. Consequently, the gasket is compressed so that the spacing between the outer door 2 and the main body 4 becomes B−5.5 mm in the embodiment (FIG. 8).

Figure 8:
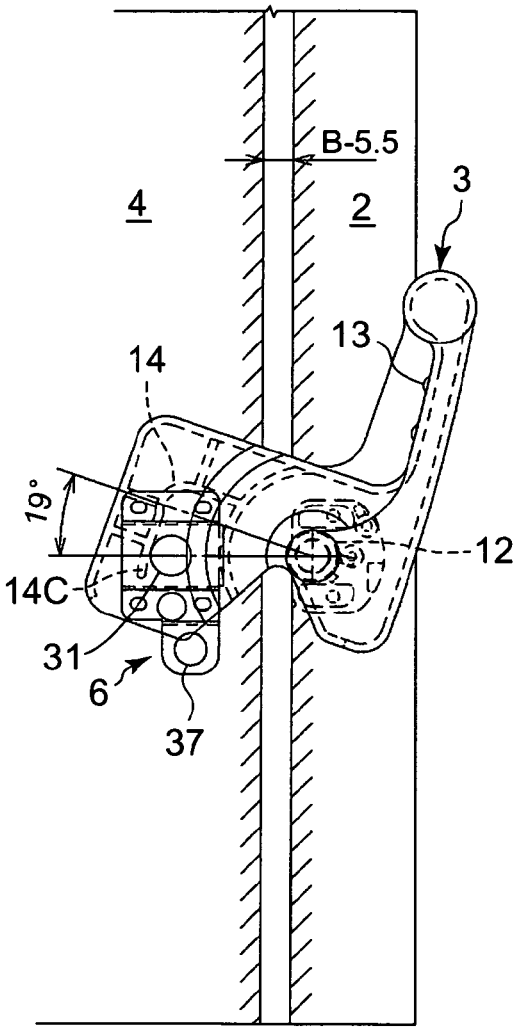
FIG. 8 is a similar view for explaining the operation for the engagement of the latch of the handle and the latch receiver of FIG. 2.
Figure 9:
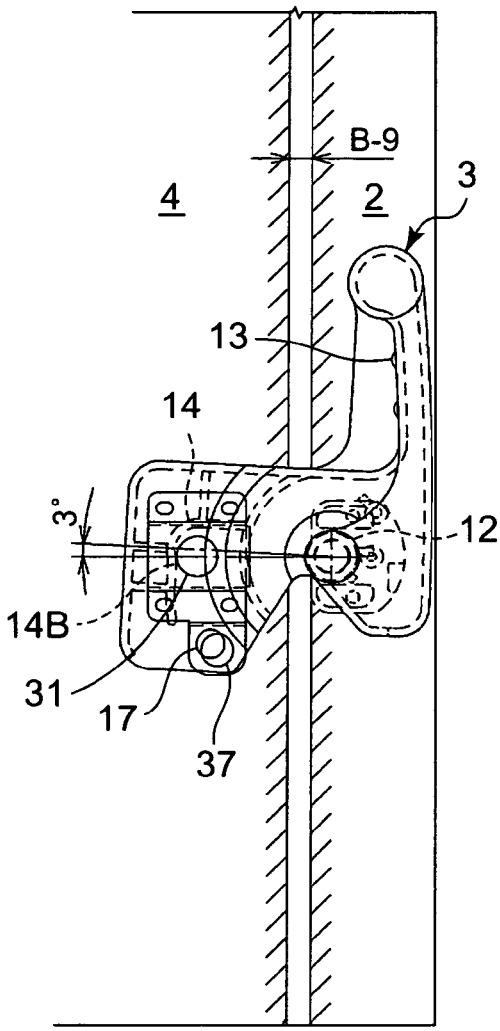
FIG. 9 is a similar view for explaining the operation for the engagement of the latch of the handle and the latch receiver of FIG. 2.

Upon the grip 13 further being pivotally moved toward its vertical position or the handle 3 being pivotally moved in counterclockwise direction in FIG. 8, the roller 31 rides up on the protrusion 14B of the latch 14 so that when the roller 31 is at the apex of the protrusion 14B, the spacing between the outer door 2 and the main body 4 becomes the minimum, that is, B−9 mm (the angle of the grip 13 with respect to the vertical plane being about 3°) (FIG. 9). At this time, the gasket is under a condition of being compressed to the maximum extent.

Figure 10:
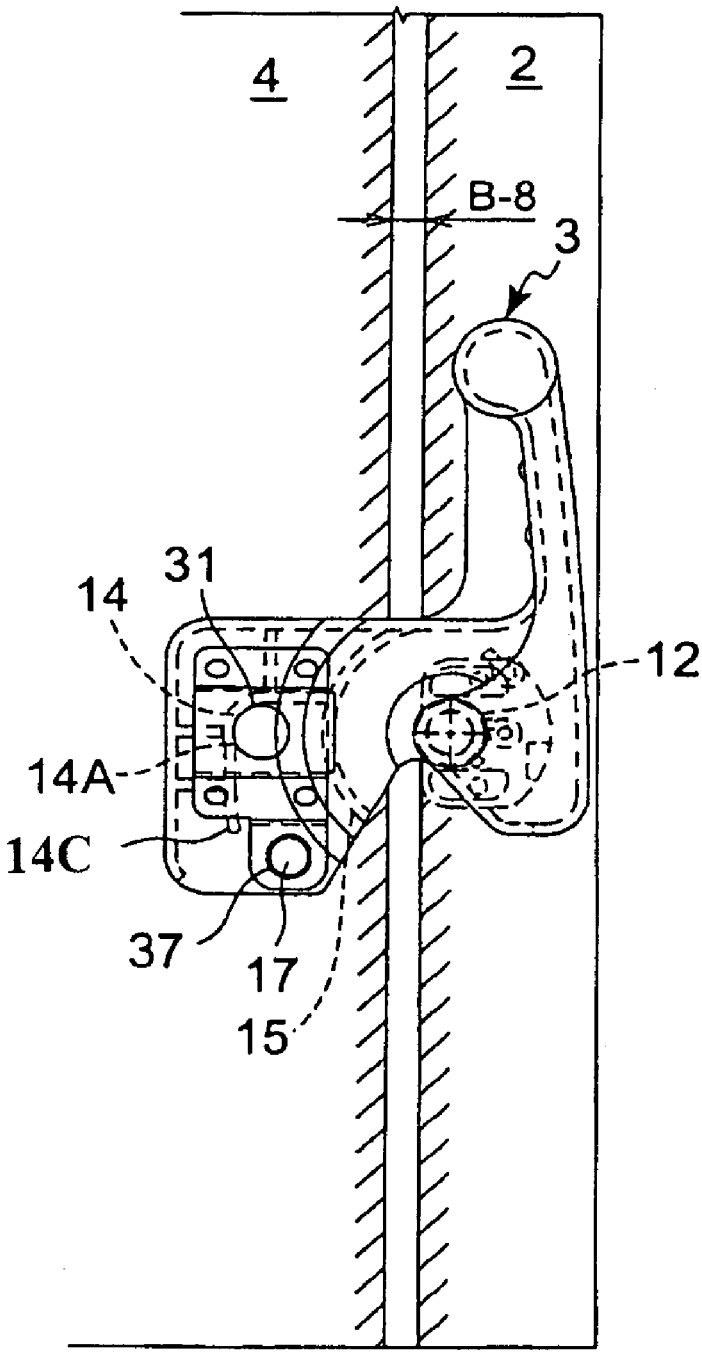
FIG. 10 is a similar view for explaining the operation for the engagement of the latch of the handle and the latch receiver of FIG. 2.

Upon the grip 13 further being pivotally moved toward its vertical position, or the handle 3 being pivotally moved in the counterclockwise direction in FIG. 9, the roller 31 rides over the protrusion 14B in time to enter a roller receiver 14A (FIG. 10). When the roller 31 of the latch receiver 6 has been accommodated in the roller receiver 14A of the latch 14 of the handle 3, as there is a protrusion 14B on the side of the forward end of the roller receiver 14A, the roller 31 cannot be readily removed from the roller receiver 14A so that the latch 14 of the handle 3 completely engages the latch receiver 6. In this way, the outer door 2 is held in its closed condition.

Moreover, in the state shown in FIG. 10, the grip 13 is substantially in a vertical state to extend along the outer door 2 so that the grip 13 does not extend from the main body significantly. Particularly, as the latch 14 is so configured that the distance from the pivot shaft portion 12 of the handle 3 progressively increases toward the tip of the latch 14, the forward end 14C of the latch 14 becomes easy to engage the roller 31 of the latch receiver 6 when the outer door 2 is being closed, while thereafter on pivotal movement of the grip 13 toward its vertical position, the latch 14 in turn operates to push the outer door 2 toward the main body 4, which operation of the latch 14 is very beneficial, particularly, for the ultra-deep freezer such as in the embodiment, in which a hermetic condition in the storage compartment 7 is an important matter.

In such an ultra-deep freezer 1, immediately after the outer door 2 has been closed, the ambient air entered the storage compartment 7 is cooled so that the interior of the storage compartment 7 becomes rapidly under a negative pressure. Although the negative pressure may be temporary, there is a risk of the roller 31 being dislodged from the roller receiver 14A of the latch 14 unless any measures are taken, because the outer door 2 is attracted toward the main body 4. However, as the handle 3 is formed with the circular arc wall 15, when the handle 3 (outer door 2) moves toward the main body 4, the roller 31 abuts against the circular arc wall 15, thereby preventing a further movement of the outer door 2 toward the main body 4. In this manner, the attraction of the outer door 2 toward the main body 4 due to the negative pressure immediately after the outer door 2 has been closed can be restrained, and the dislodgement of the roller 31 from the latch 14 can also be prevented. In the claims, circular arc wall 15 is referred to as a "stopper".

As shown in FIG. 10, moreover, the handle side lock insertion hole 17 is aligned with the main body side lock insertion hole 37 under the condition that the latch 14 completely engages the roller 31. Therefore, by inserting a lock into the aligned insertion holes 17 and 37, the outer door 2 can be easily locked.

On the other hand, when it is desired to open the outer door 2, upon the grip 13 grasped by fingers being pivotally moved away from the main body 4 from the state shown in FIG. 10, or the handle 3 being pivotally moved in the clockwise direction, the roller 31 rides over the protrusion 14B of the latch 14 to arrive at the forward end 14C and in time the projection 16 abuts against the abutment portion 28. In this way, at the moment when the pivotal movement of the handle 3 has been stopped, the engagement of the roller 31 with the latch 14 is released (in the order of FIGS. 10, 9, 8, 7 and 6). Thereafter, the outer door 2 is opened by pulling the grasped grip 13 toward the operator.

In the state that the engagement of the latch 14 with the roller 31 of the latch receiver 6 has been released in this manner, the pivotal movement of the handle 3 is stopped when the projection 16 of the handle 3 abuts against the abutment portion 28 of the latch receiver 6, and the grip 13 stands obliquely at an angle of about 45° relative to a horizontal plane (at a location intersecting the horizontal plane). Therefore, the operation for pulling the outer door 2 can be easily effected.

According to the door unit of the present invention, it becomes possible to realize the engagement of the outer door 2 with the main body 4 for holding the closed state of the outer door 2 and disengagement of the outer door 2 from the main body 4 in a series of operations for opening and closing the outer door 2, thereby enabling the opening and closing operations of the outer door 2 to be markedly easy. Moreover, as the latch 14 is provided on the handle 3, the number of parts can be reduced in comparison with the prior art separately including a handle and a latch.

Although the invention is applied to the ultra-deep freezer in the embodiment, the invention is not limited to such an application and is applicable to usual refrigerators and cold storages. However, the configuration of the present invention is particularly effective for freezers whose storage compartments become at extremely low temperatures.

What is claimed is:

1. A door unit for a cold storage including a main body having an outer front surface and two outer side surfaces orthogonal thereto, whose front surface opening is closed in an openable and closable manner by means of a door having an outer front face and two outer side faces orthogonal thereto, whose one outer side is pivotally supported on the main body, the door unit including:

a handle pivotally mounted on one outer side face of the door on its non-pivotal side at a location of a predetermined height so as to pivot about an axis extending horizontally between the two outer side faces of the door;

a latch receiver provided on the forward portion of one outer side surface of the main body at a height corresponding to the height of the handle, the latch receiver having a roller pivotally mounted thereon; and the handle integrally comprising an elongated grip adapted to be grasped by fingers of a hand along its length and a latch detachably engageable with the latch receiver so that the latch engages the latch receiver in a state that a length direction of the grip is substantially vertical when the door is in a fully closed position by action of the latch and extends along the one outer side face of the door, and when the grip is pivotally moved in a direction away from the front surface of the main body, to reach a position where the length direction of the grip is relative to a horizontal plane at a predetermined angle, then both the pivotal movement of the handle is stopped by a pivoting limiting means and the latch disengages from the latch receiver; wherein the latch is protruding portions from a rear surface of the handle that extend rearwardly toward the main body and then extend downwardly for engaging the roller, when the grip is substantially vertical, and includes a roller receiver at a corner formed by the portions extending rearwardly then extending downwardly, and when the grip is pivotally moved in a direction rearward to a substantially vertical position, the latch engages the latch receiver from upward, the roller is received in the roller receiver, and the latch engages the latch receiver completely.

2. A door unit for a cold storage including a main body having an outer front surface and two outer side surfaces orthogonal thereto, whose front surface opening is closed in an openable and closable manner by means of a door having an outer front face and two outer side faces orthogonal thereto, whose one outer side is pivotally supported on the main body, the door unit including:

a handle pivotally mounted on one outer side face of the door on its non-pivotal side at a location of a predetermined height so as to pivot about a pivot shaft having an axis extending horizontally between the two outer side faces of the door;

a latch receiver provided on the forward portion of one outer side surface of the main body at a height corresponding to the height of the handle, the latch receiver having a roller pivotally mounted thereon; and the handle integrally comprising an elongated grip adapted to be grasped by fingers of a hand along its length and a latch detachably engageable with the latch receiver so that the latch engages the latch receiver in a state that a length direction of the grip is substantially vertical when the door is in a fully closed position by action of the latch and extends along the one outer side face of the door, and when the grip is pivotally moved in a direction away from the front surface of the main body, to reach a position where the length direction of the grip is relative to a horizontal plane at a predetermined angle, then both the pivotal movement of the handle is stopped by a pivoting limiting means and the latch disengages from the latch receiver;

wherein the latch is protruding portions from a rear surface of the handle that extend rearwardly toward the main body and then extend downwardly for engaging the roller, when the grip is substantially vertical, and includes a roller receiver at a corner formed by the portions extending rearwardly and then extending downwardly such that a distance from the pivot shaft of the handle to the latch progressively increases toward a lower end of the downwardly extending end of the latch;

when the grip is pivotally moved in a direction rearward to a substantially vertical position, the latch engages the latch receiver from upward, the roller is received in the roller receiver, and the latch engages the latch receiver completely; and a protrusion extending toward the pivot shaft is formed on the latch at a location below the roller receiver of the latch and a distance from the pivot shaft to a forward end of the protrusion progressively increases from the protrusion toward the lower end of the latch.

3. The door unit for a cold storage as set forth in claim 1, wherein the handle comprises a stopper which regulates movement of the door toward the main body in the state that the latch engages the latch receiver.

4. The door unit for a cold storage as set forth in claim 1, wherein the handle comprises a handle side lock insertion hole which is aligned with a main body side lock insertion hole provided in the latch receiver in the state that the latch engages the latch receiver.

5. The door unit for a cold storage as set forth in claim 2, wherein the handle comprises a stopper which regulates movement of the door toward the main body in the state that the latch engages the latch receiver.

6. The door unit for a cold storage as set forth in claim 2, wherein the handle comprises a handle side lock insertion hole which is aligned with a main body side lock insertion hole provided in the latch receiver in the state that the latch engages the latch receiver.

7. The door unit for a cold storage as set forth in claim 3, wherein the handle comprises a handle side lock insertion hole which is aligned with a main body side lock insertion hole provided in the latch receiver in the state that the latch engages the latch receiver.

8. The door unit for a cold storage as set forth in claim 5, wherein the handle comprises a handle side lock insertion hole which is aligned with a main body side lock insertion hole provided in the latch receiver in the state that the latch engages the latch receiver.

* * * * *